US005489317A

United States Patent [19]

Bergevin

[11] Patent Number: 5,489,317

[45] Date of Patent: Feb. 6, 1996

[54] SURFACE FOR SPORTS AND OTHER USES

[75] Inventor: Jerry G. Bergevin, Lynnwood, Wash.

[73] Assignee: Turf Systems International, Inc., Lynnwood, Wash.

[21] Appl. No.: 319,322

[22] Filed: Oct. 4, 1994

Related U.S. Application Data

[63] Continuation of Ser. No. 902,147, Jun. 22, 1992, abandoned.

[51] Int. Cl.[6] ..... E01C 13/00

[52] U.S. Cl. ..... 47/1.01; 47/58

[58] Field of Search ..... 47/1 F, 58.25

[56] References Cited

U.S. PATENT DOCUMENTS

| | | | |
|---|---|---|---|
| 3,446,122 | 5/1969 | Raichle et al. | 94/7 |
| 3,703,786 | 11/1972 | Swan | 47/56 |
| 4,007,556 | 2/1977 | Glück . | |
| 4,023,506 | 5/1977 | Robey | 111/1 |

(List continued on next page.)

FOREIGN PATENT DOCUMENTS

| | | | |
|---|---|---|---|
| 0154841A3 | 2/1985 | European Pat. Off. . | |
| 0174755 | 3/1986 | European Pat. Off. . | |
| 0204381A1 | 12/1986 | European Pat. Off. . | |
| 0261769A1 | 3/1988 | European Pat. Off. | 47/18 |
| 263566A1 | 4/1988 | European Pat. Off. . | |
| 0373282A1 | 12/1988 | European Pat. Off. . | |
| 0403008A1 | 12/1990 | European Pat. Off. . | |
| 2333534 | 1/1977 | France . | |
| 2556381A1 | 6/1985 | France . | |
| 1817624.4 | 5/1968 | Germany . | |
| 2160576 | 6/1973 | Germany . | |
| 2522864 | 12/1976 | Germany . | |
| 3226830A1 | 1/1984 | Germany | 27/10 |
| 3313329A1 | 10/1984 | Germany . | |
| 3602060A | 7/1987 | Germany . | |
| 3703866A1 | 8/1988 | Germany . | |
| 3723364A1 | 1/1989 | Germany . | |
| 8500946 | 10/1986 | Netherlands . | |
| 2225240 | 5/1990 | United Kingdom . | |
| WO92/07142 | 4/1992 | WIPO . | |
| 91/202 | 4/1992 | WIPO | 47/1 F |

OTHER PUBLICATIONS

"Brabauts Dagblad" (newspaper), Jul. 14, 1992, Holland.

"The 'Envelope' Base System," Safety Play Systems Inc., Victoria, B.C. (5 pages).

"Netlon Advanced Turf–Where Turf Alone Would Fail," Netlon, Blackburn, England (7 pages).

"Keep Off–Your Feet Are Killing Me!," *Notts Sport News,* Golf Edition, Victoria, B.C. (2 pages).

"Children at Play–The Next Four Years," *Notts Sport News,* Childsplay Edition (2 pages).

"Notts Sport Grass Reinforcement Passes Tough Scottish Trials," *Notts Sport News,* Grass Reinforcement Edition, Spring, 1990 (2 pages).

"Netlon Advanced Turf—Rootzone Technology—Stronger by Nature," Netlon, Blackburn, England, Jan., 1992.

"The Tried and Tested Sand–Filled Artificial Turf," *DLW Sportfloor,* date unknown.

"Sand–Filled Artificial Turf—We take Nature as our Model," *DLW Sportfloor,* date unknown.

*Primary Examiner*—Henry E. Raduazo

*Attorney, Agent, or Firm*—Christensen, O'Connor, Johnson & Kindness

[57] ABSTRACT

An improved surface includes a foundation constructed of a subgrade and a sub-base. A synthetic turf is positioned atop the foundation and includes synthetic grass blades secured to a backing. The synthetic turf also includes a surface layer of material supported by the backing and intermixed with the synthetic grass blades. Natural grass is planted in the surface layer of material wherein the natural grass includes natural grass blades and roots. The backing is provided with perforations sufficient in number to permit the roots of the natural grass to extend through the backing into the sub-base of the foundation. The natural grass improves the overall desirability of the surface by improving its durability, increasing its life span, reducing the cost of installation, reducing the cost of maintenance, and improving the benefits to the ecology.

29 Claims, 7 Drawing Sheets

U.S. PATENT DOCUMENTS

| | | | |
|---|---|---|---|
| 4,073,753 | 2/1978 | Hauge | 260/2.3 |
| 4,318,248 | 3/1982 | Muldner | 47/56 |
| 4,462,184 | 7/1984 | Cunningham | 47/58 |
| 4,501,420 | 2/1985 | Dury | 272/3 |
| 4,572,700 | 2/1986 | Mantarro et al. | 404/35 |
| 4,852,870 | 8/1989 | Hawkins et al. | 272/3 |
| 5,014,462 | 5/1991 | Malmgren et al. | 47/1.01 |

SURFACE FOR SPORTS AND OTHER USES

This application is a continuation application based on prior application Ser. No. 07/902,147, filed on Jun. 22, 1992, abandoned.

TECHNICAL FIELD OF THE INVENTION

The present invention is directed toward an improved surface for sports and other uses and, more particularly, toward a combination artificial and natural surface and method of making the same.

BACKGROUND OF THE INVENTION

For years natural turf surfaces were used for most outdoor sports such as, for example, soccer, football, field hockey, cricket, rugby, etc. Natural turf surfaces are surfaces constructed with a grass grown in soil, or some other surface layer of material (e.g., sand, sand and organic mixes, etc.), that is constructed upon a suitable foundation. Natural turf surfaces are generally preferred for their comfort, feel, grip, and appearance.

However, under heavy use and/or poor weather conditions, natural turf surfaces deteriorate rapidly and maintenance is costly. Intense activity on the turf destroys the turf and the root system, leaving mud and/or dirt as the playing surface. Due to the needs of the sports programs, play usually continues until the season is over and the field can be re-established. During this time, prior to re-establishment, the surface is often pockmarked, uneven, and possibly even hazardous to use. Further, these natural turf surfaces are not useable during the re-establishment period because any use would defeat the reestablishment of the grass.

More recently, synthetic turf surfaces have been used as an alternative to natural turf surfaces. Synthetic turf surfaces generally come in two varieties, i.e.; non-sand filled and sand filled synthetic turf. Non-sand filled synthetic turf is a dense synthetic material that takes the appearance of grass blades and is mounted indoors or outdoors, usually upon an asphalt and cushion foundation. Sand filled synthetic turf is a synthetic material similar to the non-sand filled synthetic turn, but is generally less dense than non-sand filled turf, and is filled with silica sand. The sand filled synthetic turf is mounted outdoors only upon structures similar to those used for non-sand filled turf and sometimes on other foundations of crushed rock cushion materials (rubber particles) mixed therein. Both may be used in conjunction with subsurface drainage.

Although synthetic turf surfaces are more durable and easier to maintain than natural turf surfaces they, are only moderately successful for sports and other uses for many reasons. The most notable of the disadvantages of the synthetic turf surfaces is the discomfort for sports use, particularly over heating in the direct sun, unnatural traction, and friction burns . Additionally, these surfaces are generally expensive to cream and have a life expectancy of 8–12 years. Still further, outdoor synthetic turf facilities remove vast areas from the cleosystem, reducing natural processes including ground water recharge, oxygen and carbon monoxide balance, temperature modulation, and dust filtration. For these reasons, a number of synthetic turf surfaces are being converted back to the natural turf surfaces, discussed above.

It is desirable, therefore, to provide an improved surface for sports and other uses, and a method of making the improved surface, wherein the surface will provide comfort to the users, will be a durable surface under heavy use and in poor weather conditions, and which can be less expensive to create and maintain. Further, it is desirable to provide such a surface that will not remove vast areas of the earth surface from the ecosystem.

SUMMARY OF THE INVENTION

The present invention provides an improved surface for sports and other uses. The surface includes a foundation and a synthetic turf positioned atop the foundation. The synthetic turf includes synthetic grass blades intermixed with a surface layer of material. The synthetic turf also includes a base for supporting the synthetic grass blades and the surface layer of material atop the foundation. The synthetic grass blades are constructed of a substantially flexible, synthetic material. The surface of the present invention further includes natural grass having natural grass blades and roots associated therewith. The natural grass is planted in the surface layer of material so that the natural grass is intermixed with the synthetic grass blades and so that the roots of the natural grass blades extend downward through the surface layer of material.

In a second embodiment of the invention, the improved surface includes a rubber mat having rubber particles adhered together by urethane, latex or other binding materials to create a flexible, perforated, cushion. The rubber mat is positioned intermediate the foundation and the synthetic turf.

In a third embodiment of the invention, the improved surface is constructed with a foundation and a rubber mat positioned atop the foundation. The rubber mat includes rubber particles adhered together by urethane, latex, or other binding materials to create a flexible, perforated, cushion.

In a fourth embodiment of the invention, the rubber material is filled with sand particles, and natural grass is planted in the sand filled spaces so that the roots of the natural grass extend downward through the rubber mat into the foundation. The improved surface is constructed with a surface layer of material positioned atop. the rubber mat. Natural grass is planted in the surface layer of material so that the roots of the natural grass blades extend downward through the surface layer of material and the perforations of the rubber mat into the foundation.

DETAILED DESCRIPTION OF THE INVENTION

Figure 1:
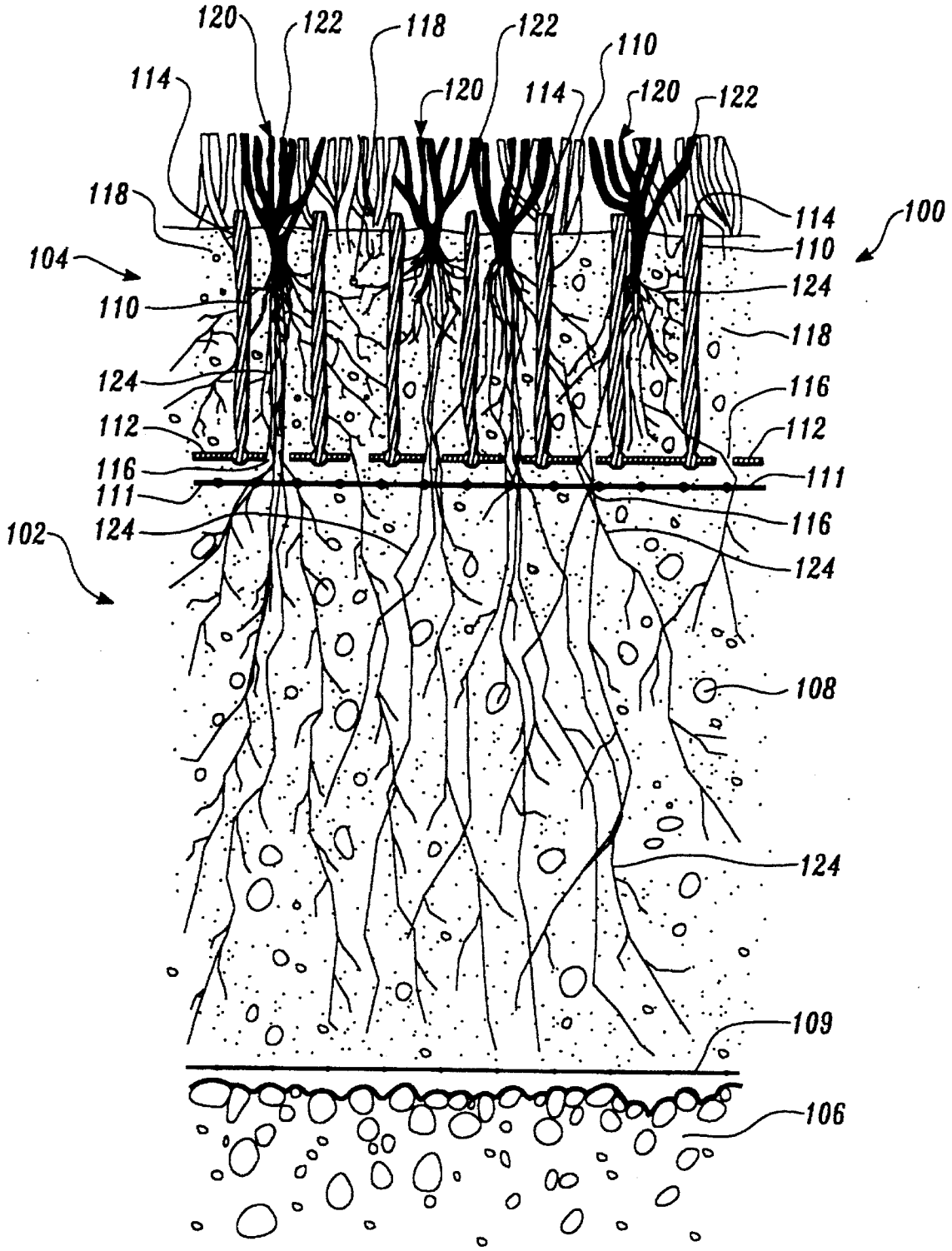
FIG. 1 is a partial sectional view of a first embodiment of the improved surface of the present invention.

An improved surface 100 is illustrated in FIG. 1. The improved surface 100 includes a foundation 102 upon which is mounted a synthetic turf 104. The foundation 102 is constructed of a subgrade 106 and a sub-base 108. The subgrade 106 is constructed for providing drainage and irrigation to the sub-base 108 and a firm foundation for the synthetic turf 104. The subgrade 106 may be formed of earth and rock as is known in the art. Further, the subgrade may be provided with suitable structure for providing irrigation to the sub-base 108 synthetic turf 104 and natural grass 120 . A subgrade for use with the invention may be readily provided by those skilled in the art.

The sub-base 108 is positioned atop the subgrade 106 and is constructed to provide sufficient drainage of water from the synthetic turf 104 to the subgrade 106. The sub-base 108 may be constructed of any combination of materials known to those skilled in the art such as, for example, sand, rubber, rock, and other organic or inorganic materials. Like the subgrade 106, the subbase 108 may be readily constructed by those skilled in the art.

A structural fabric filter 109 is positioned intermediate the subgrade 106 and the sub-base 108 and a permeable filter 111 is positioned intermediate the synthetic turf 104 and the sub-base 108. The permeable filter 109 is constructed to permit the flow of water from the synthetic turf 104 to the sub-base 108. The structural fabric is constructed to act as a barrier between the sub-base 108 anti subgrade 106 to prevent the flow of water and other materials from one to the other. The structural fabric 109 would not be placed over drain lines or channels (400 and 402). The permeable filter 111 is further constructed to substantially prevent the flow of other substances from the synthetic turf 104 to the sub-base 108. Adequate permeable filter 111 may readily be selected by those skilled in the art. Also, it will be apparent to those skilled in the art that either the structural fabric 109 or the permeable filter 111 or both may be eliminated in some applications without departing from the spirit of the present invention.

The present invention is intended for use as a sports playing field, in which case the subgrade 106 and sub-base 108 will most likely be desired to insure adequate support, drainage, and irrigation to the improved surface 100. However, as will become apparent to those skilled in the art, the present invention is also suitable for use as other surfaces, such as, for example, road medians, home yards, parks, and virtually anywhere where a grass surface is desired. In such applications, the subgrade 106 and sub-base 108 may be modified to suit the particular use to which the invention is being put. Further, in some applications, it may be desirable to eliminate the subbase 108 altogether. However, it is generally desirable to provide some foundation 102, if nothing more than a prepared earth surface, upon which the synthetic turf 104 can be supported.

Figure 6A:
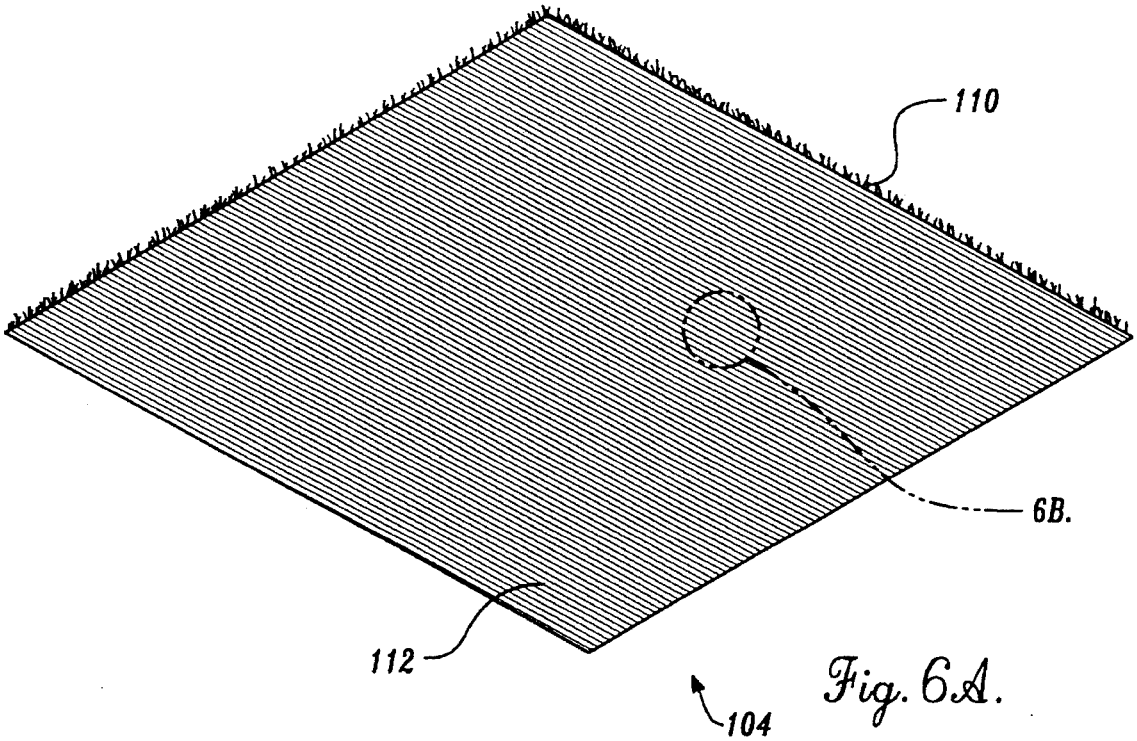
FIG. 6 is a perspective view of the backing of the artificial turf that is a portion of the improved surface of the subject invention.
Figure 6B:
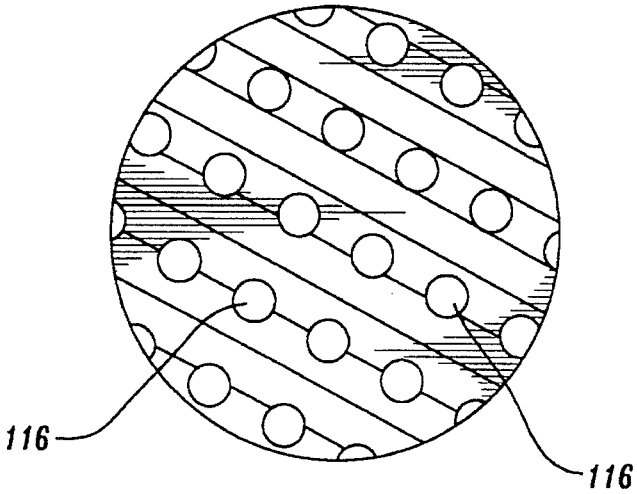

The synthetic turf 104 includes a multiplicity of imitation grass blades 110 secured to a flexible backing 112. The imitation grass blades 110 are constructed of a synthetic material that is substantially flexible. The imitation grass blades 110 each extend outward from the flexible backing 112 and include top portions 114 that are distant from the flexible backing 112. The top portions each extend upward from the flexible backing in the same direction. The flexible backing 112 includes a plurality of perforations 116 (shown more clearly in FIG. 6) that permit water drainage therethrough to the foundation 102.

Figure 7A:
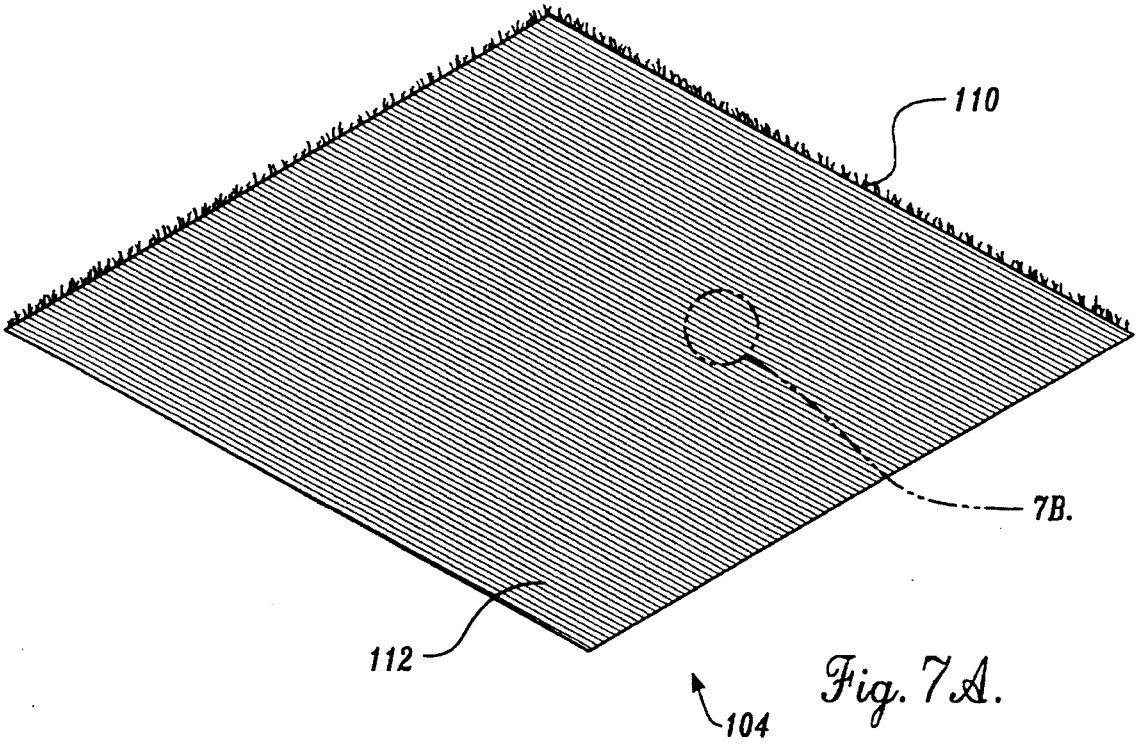
FIG. 7 is a perspective view of an alternative backing of the artificial turf that is a portion of the improved surface of the subject invention.
Figure 7B:
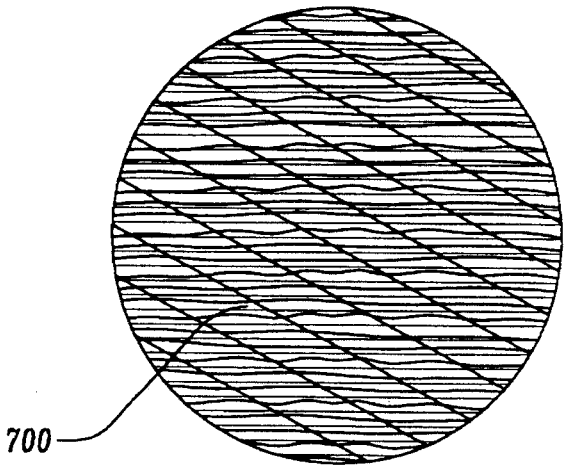

In the presently preferred embodiment of the invention, the imitation grass blades 110 are tufted to a mesh, and the mesh is covered with a latex material to retain the imitation grass blades 110 in position. It will be apparent, however, to those skilled in the art that the flexible backing 112 may be constructed from any suitable material for positioning the imitation grass blades 110 and retaining the imitation grass blades 110 in the desired position. As an example, instead of being tufted, the imitation grass blades 110 could be woven to a flexible backing 112 of woven material 700, as illustrated in FIG. 7. Further, the imitation grass blades 110 could be tufted to a mesh and retained by materials other than latex, as for example urethane, corn starch or a biodegradable material. Those skilled in the art will appreciate that a variety of ways for providing the imitation grass blades and retaining them in position with a backing is possible without departing from the spirit of the subject invention.

Presently, the invention is contemplated using synthetic grass blades that are 15 to 24 millimeters in length and that have a density ranging from 8 to 28 grass blades per 10 centimeters depending upon the intended use. However, longer or shorter blades could be used with greater or lesser density.

The synthetic turf 104 may be readily constructed by those skilled in the art. Generally, synthetic turf constructions that are used with sand filled synthetic turf surfaces are suited for use as the synthetic turf 104 of the present invention. However, it is preferable that the number of perforations be increased and that the density of synthetic strands be decreased, for reasons that will become apparent from a further reading of this detailed description of the invention.

Returning to FIG. 1, the synthetic turf 104 further includes a surface layer of material 118 positioned atop the flexible backing 112. The surface layer of material 118 preferably fills the synthetic turf 104 from the flexible backing 112 to a point proximate the top portion 114 of the imitation grass blades 110. It is desirable to not completely fill the synthetic turf 104 with the surface layer of material 118 so as to permit the top portions 114 of the imitation grass blades 110 to extend outward beyond the surface layer of material 118, as will be described in more detail below.

The improved surface 100 further includes natural grass 120 that is planted in the surface layer of material 118. The natural grass 120 includes a multiplicity of grass blades 122 each having a crown and roots 124 associated therewith. The natural grass 120 is planted in the surface layer of material 118 so that the roots 124 extend downward through the surface layer of material 118 and through the perforations 116 of the flexible backing 112. As mentioned above, it is desirable to provide perforations adequate in number to permit adequate drainage of water from the surface layer of material 118 to the subbase 108. It is further desirable to provide perforations 116 adequate in number to permit the roots 124 adequate passage from the surface layer of material 118 to the sub-base 108.

The surface layer of material 118 may comprise any of a variety of materials for supporting the natural grass 120. In the presently preferred embodiment of the invention, the surface layer of material 118 is a mixture of sand and organic particles with rubber cushioning particles optional. However, it will be apparent to those skilled in the art that the surface layer of material may comprise any of a variety of materials for supporting the natural grass 120.

Along these lines, it is to be noted that due to the improved construction of the synthetic turf 104 in combination with the natural grass 120, the selection of adequate materials for the surface layer of materials 118 is not limited as with presently available sand filled synthetic turf surfaces. As an example, it is generally accepted that only silica sand, a somewhat rare and expensive sand, is suited for use with sand filled synthetic turf surfaces. This is because other sands will tend to drift when dry, destroying the smoothness of the surface. However, due to the tendency of the roots 124 of the natural grass 120 of the present invention to hold the surface layer of material 118 in place, a variety of sands may be used in the improved surface 100 of the subject invention without penalty.

Still further, although it is desirable to mix rubber, or other cushioning particles with the sand, it is generally accepted that rubber particles cannot be mixed with the silica sand of prior art sand filled synthetic turf surfaces. This is because water and agitation of the sand will tend to separate the rubber particles from the sand, bringing the rubber particles to the top. However, due to the tendency of the roots 124 of the subject invention to hold the surface layer of material 118 in place, rubber particles may be mixed with the selected surface layer of material to thereby provide a more comfortable playing surface.

As noted above, it is desirable to permit the top portions 114 of the imitation grass blades 110 to extend outward beyond the surface layer of material 118. This provides protection to the crown and roots 124 of the natural grass 120 thereby improving the durability of the natural grass. Further, at times when the blades 122 of the natural grass 120 are worn short, the imitation grass blades 110 of the synthetic turf 104 will both protect the crown and roots 124 from being completely destroyed and will provide a visually pleasing surface. Still further, since the root system of the natural grass 120 will not be destroyed, the blades 122 of the natural grass 120 will return without the maintenance required for fully natural surfaces.

Another advantage of the present invention is that the blades 122 of the natural grass 120 shield sunlight from the imitation grass blades 110 of the synthetic turf 104 substantially reducing the breakdown of the synthetic imitation grass blades 110 due to ultraviolet light. Further, the incorporation of the natural grass 120 with the synthetic turf 104 reduces wear of the imitation grass blades 110 since the roots 124 of the natural grass 120 reduce the grinding action of the sand on the imitation grass blades 110. Further, many other sands are less abrasive than silica sand, and use of such other sands reduces friction wear. This reduction in wear and ultraviolet light breakdown increases the expected life of the improved surface 100 thereby reducing the long term cost of the surface.

Figure 2:
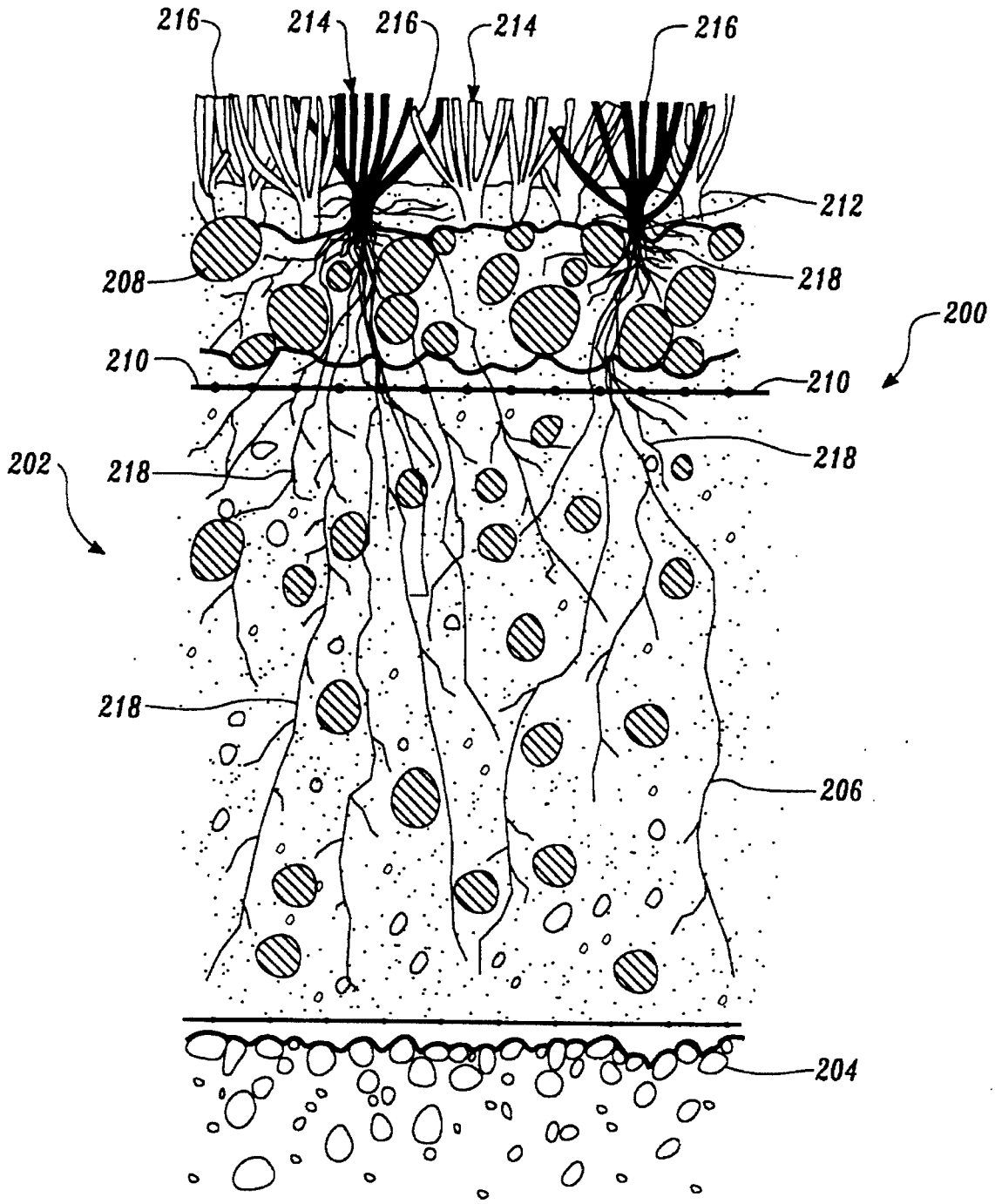
FIG. 2 is a partial sectional view of a second embodiment of the improved surface of the subject invention.

Referring to FIG. 2, (note: this includes the second and third embodiments, being with and without the layer of surface material atop the cushion mat) an alternative embodiment of the subject invention is illustrated. Therein, an improved surface 200 includes a foundation 202 made of a subgrade 204 and a sub-base 206. The foundation 202, including the subgrade 204 and sub-base 206 may be constructed like the foundation 102 illustrated in FIG. 1.

The improved surface 200 also includes a resilient cushioning mat 208 of rubber or other cushioning materials positioned atop the foundation 202. The cushioning mat 208 comprises a perforated resilient mat. In the presently preferred embodiment of the invention, the cushioning mat 208 is constructed of rubber particles adhered together with urethane to create a flexible, perforated, cushion. However, those skilled in the art will appreciate that the cushioning mat 208 could be constructed of a variety of cushioning materials used with or without a binder. As an example, the cushioning mat 208 could comprise polystyrene. Other constructions for the cushioning mat 208 will readily become apparent to those skilled in the art.

A perforated filter 210, similar to the perforated filter 111 illustrated in FIG. 1, is positioned intermediate the cushioning mat 208 and the foundation 202. A surface layer of material 2 12 is positioned atop and in the perforations in the cushioning mat 208. Natural grass 214 having blades 216 and roots 218 is planted in the surface layer of material 212.

As discussed above by reference to FIG. 1, the natural grass 214 is planted so that the roots 218 will grow downward through the surface layer of material 212 and the perforations of the cushioning mat 208 into the sub-base 206 of the foundation 202. As with the embodiment of FIG. 1, the roots 218 of the natural grass 214 hold the surface layer of material 212 in place increasing the types of materials, and mixture of materials, that can be selected for the surface layer of material 212. Additionally, the cushioning mat 208 provides flexibility to the improved surface 200 making it a comfortable surface. The improved surface 200 is suitable for use in applications where the requirements for durability are not as strenuous as with the embodiment of FIG. 1.

Figure 3:
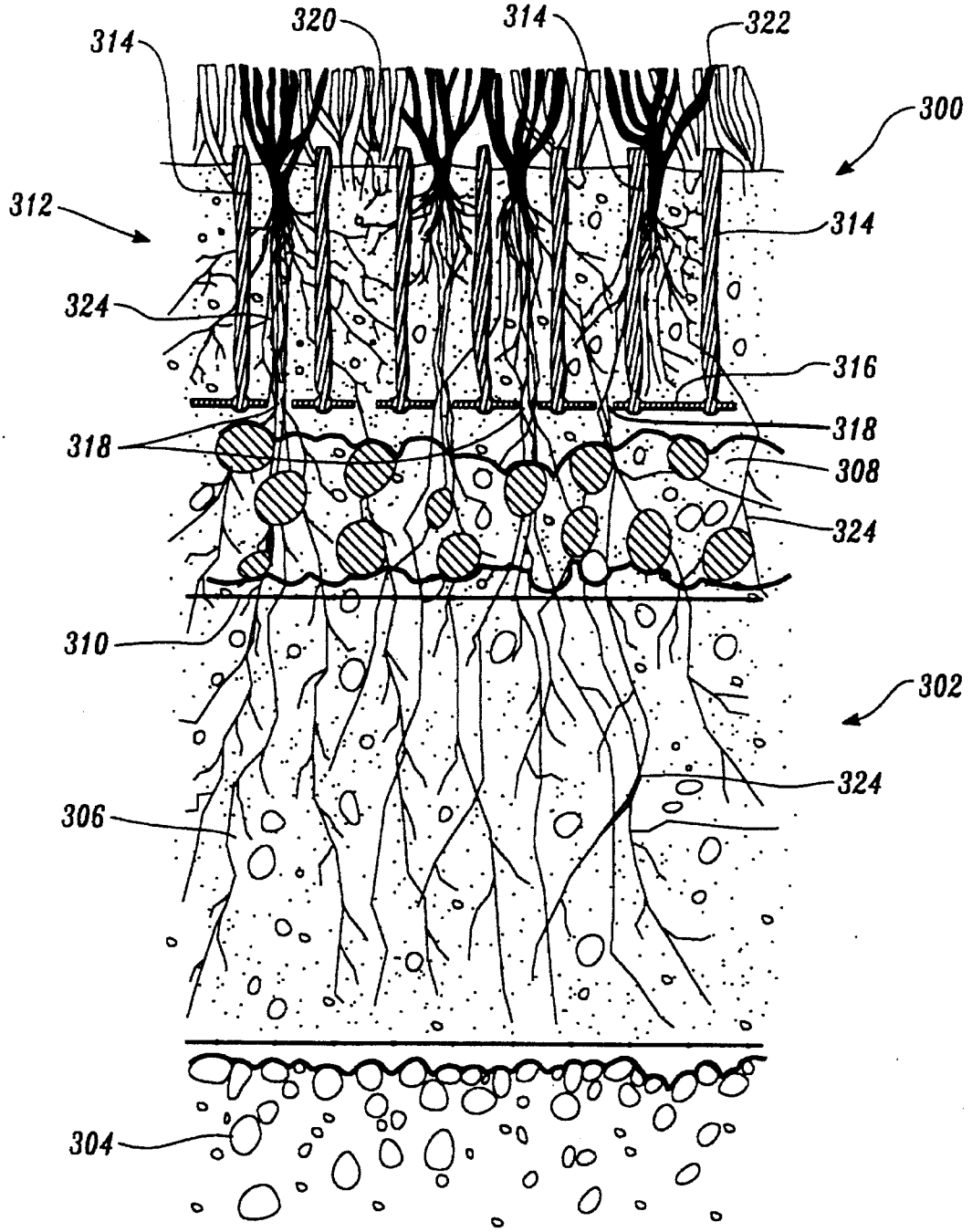
FIG. 3 is a partial sectional view of an embodiment of the present invention comprising a combination of the embodiments of FIGS. 1 and 2.

Referring to FIG. 3, a still fourth embodiment of the invention is illustrated. Therein, an improved surface 300 includes a foundation 302 made of a subgrade 304 and a sub-base 306 separated by a structural fabric 3. The improved surface 300 also includes a cushioning mat 308 positioned atop the foundation 302 with a perforated filter 310 positioned there between. A synthetic turf 312 is positioned atop the cushioning mat 308 and includes a plurality of imitation grass blades 3 14 secured to a flexible backing 316. The flexible backing 316 including perforations 318. The synthetic turf 312 including a surface layer of material 320 having natural grass 322 planted therein.

As with the embodiment of FIG. 1, the perforations 318 are sufficient to permit roots 324, associated with the natural grass 322, to extend through the flexible backing 316. Further, the roots 324 extend through the perforations of the cushioning mat 308 into the sub-base 306 of the foundation 302. The embodiment of FIG. 3 provides all of the above discussed advantages of the embodiment of FIG. 1 with the added comfort to the users of the surface provided by the cushioning mat 308.

Figure 4:
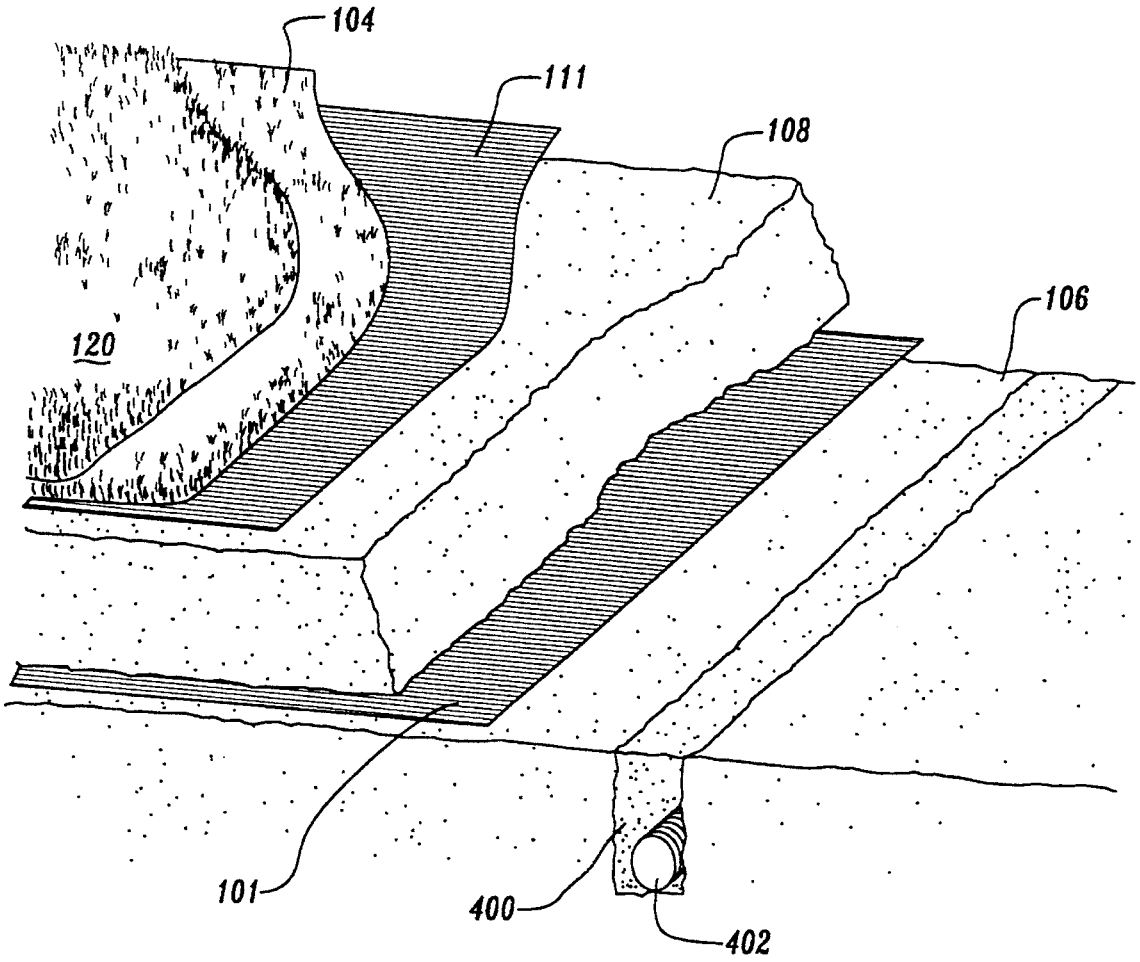
FIG. 4 is a partial cutaway view showing how the improved surface of the subject invention is constructed.

Referring to FIG. 4, a description of the manner of constructing the improved surface 100 illustrated in FIG. 1 will be described. Initially, the subgrade 106 is prepared by adding irrigation and drainage channels 400 and drainage pipes 402. Thereafter, the structural fabric 109 is added atop the subgrade 106, if desired, and is followed by the sub-base 108. If the perforated filter 111 is desired it is placed upon the sub-base 108 followed by the synthetic turf 104, including the surface layer of material 118. After the synthetic turf 104 has been placed in position, the natural grass 120 is planted so that the crown and roots 124 can form, as described above. Those skilled in the art will appreciate that one significant advantage of the present invention is that, since the crown and root system 124 of the natural grass 120 hold the synthetic turf 104 in place, no seaming tape, or other types of securing means is usually not needed to hold the synthetic turf 104 in position.

Figure 5:
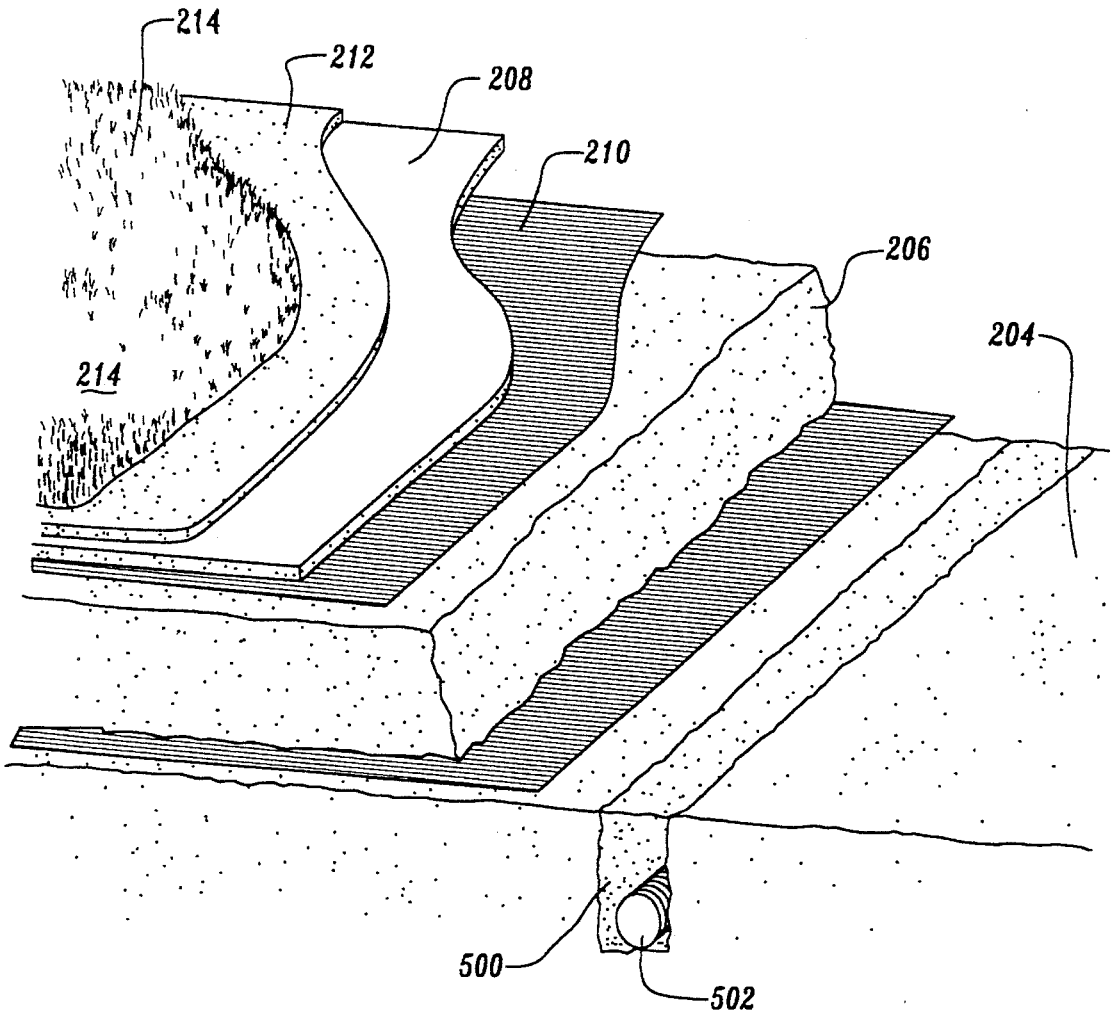
FIG. 5 is a partial cutaway view showing how the alternative embodiment of the invention is constructed.

With reference to FIG. 5, the manner of constructing the embodiment of the invention illustrated in FIG. 2 will be described. Therein, the subgrade 204 is first formed with drainage and irrigation channels 500 and drainage pipes 502.

The sub-base 206 is formed atop the subgrade 204 and is covered with the perforated falter 210, if desired. The cushioning mat 208 is placed atop the sub-base 206 and is covered with the surface layer of material 212. The natural grass 214 is then planted in the surface layer of material.

It will be apparent to those skilled in the art that although only several presently preferred embodiments of the invention have been described in detail herein, many modifications and variations may be provided without departing from the true scope and spirit of the invention. Accordingly, the invention is not limited except as by the appended claims.

I claim:

1. A surface for sports and other uses, said surface comprising:

a foundation for supporting said surface;

a cushioning layer of material positioned atop said foundation, said cushioning layer of material having a multiplicity of perforations and including rubber particles adhered together by urethane to create a flexible, perforated cushion;

a surface layer of material positioned atop said cushioning layer of material; and natural grass including a multiplicity of natural grass blades each having roots associated therewith, said natural grass being planted in said surface layer of material so that said roots of said multiplicity of natural grass blades extend downward through said surface layer of material and said perforations of said cushioning layer of material and into said foundation.

2. The surface as recited in claim 1 wherein said foundation comprises:

a compacted subgrade formed of earth and rock for providing a foundation, said compacted subgrade including drainage away from the surface; and a sub-base positioned atop said compacted subgrade, said sub-base including a mixture of sand, rubber, and rock in relative quantities to provide sufficient drainage of water to said compacted subgrade.

3. The surface as recited in claim 2 further including a perforated filter intermediate said compacted subgrade and said sub-base, said perforated filter being designed to permit the flow of water from said sub-base to said compacted subgrade and to substantially prevent the flow of other substances from said sub-base to said compacted subgrade.

4. The surface as recited in claim 1 further including a perforated filter intermediate said foundation and said cushioning layer of material, said perforated filter being designed to permit the flow of water from said cushioning layer of material to said foundation and to substantially prevent the flow of other substances from said cushioning layer of material to said foundation.

5. A grass playing surface comprising:

(a) a foundation;

(b) all artificial grass turf located on top of tile foundation, the artificial grass turf having generally vertically upright fibers mounted in a porous backing, file fibers having at least one free end and extending upward in the same general direction;

(c) a layer of growth medium disposed ill the artificial grass turf to a depth sufficient to substantially fill the artificial grass turf to the top of tile fibers; and (d) natural grass plants, having grass blades, crowns and roots, disposed in tile growth medium, tile roots extending downwardly through he growth medium, tile artificial grass turf and into the foundation the crowns being located slightly below tile top of tile fibers and tile blades extending upwardly above the top of the fibers forming a playing surface of substantially natural grass.

6. The grass playing surface of claim 5, wherein the backing material is formed at least partially of a biodegradable material.

7. The grass playing surface of claim 5, wherein the fibers are tufted into the backing material.

8. The grass playing surface of claim 5, wherein the foundation includes a perforated filter configured to permit the flow of water through the perforated filter and to substantially prevent the flow of other substances through the perforated filter.

9. The grass playing surface of claim 5, wherein a density of the synthetic grass blades is approximately 784 grass blades per ten square centimeters.

10. The grass playing surface of claim 5, wherein a density of the synthetic grass blades is approximately 169 grass blades per ten square centimeters.

11. The grass playing surface of claim 5, wherein the growth medium is a mixture of sand and rubber particles.

12. The grass playing surface of claim 5, wherein the blades extend a sufficient distance above the top of the fibers to protect the artificial grass turf from damage due to ultraviolet light.

13. The grass playing surface of claim 5, wherein the fibers extend upwardly from the backing material a sufficient distance to protect the roots and crowns from damage during use but do not extend a sufficient distance above the crowns to protect the blades from damage during use.

14. A durable natural grass playing surface comprising:

(a) a foundation;

(b) artificial grass means for protecting drowns and roots of natural grass plants located on file foundation, the artificial grass means including artificial grass fibers mounted in a porous backing material, the fibers including a free end and extending vertically upward in the same general direction from the backing material, a growth medium disposed in the artificial grass fibers to a point proximate the top of the artificial grass fibers; and (c) the natural grass plants having roots, crowns, and blades, file roots extending downwardly through the artificial grass means and into the foundation, the crowns being located below the top of the artificial grass fibers and the blades extending upwardly above the top of the artificial grass fibers to form the playing surface of natural grass blades.

15. The playing surface of claim 14, wherein the porous backing material is at least partially formed of a biodegradable material.

16. The playing surface of claim 14, wherein the fibers are tufted into the backing material.

17. The playing surface of claim 14, further comprising a perforated filter designed to permit the flow of water through the foundation and to substantially prevent the flow of other substances through the foundation.

18. The playing surface of claim 14, further comprising a cushioning layer of material positioned on top of the foundation, the cushioning material including rubber particles adhered together by urethane to create a flexible, perforated cushion.

19. The playing surface of claim 14, wherein the artificial grass fibers extend a sufficient distance from the backing material to protect the crowns and roots of the natural grass plants, but do not extend a sufficient distance to protect the blades of natural grass plants from damage during use.

20. The playing surface of claim 14, wherein the artificial grass fibers terminate adjacent an upper surface of the artificial grass means.

21. The playing surface of claim 14, wherein the blades of the natural grass plants extend a sufficient distance above the artificial grass means to protect the artificial grass means from damage due to ultraviolet light.

22. A reinforced grass playing surface comprising:

(a) a foundation;

(b) a porous backing material located on top of the foundation;

(c) generally vertically upright artificial fibers mounted in the backing material and extending upward in the same general direction from the backing material file fibers including at least one free end;

(d) a layer of growth medium disposed on top of the backing material around the artificial fibers to a depth proximate the top of the artificial fibers; and (e) natural grass plants disposed on top of the growth medium.

23. The playing surface of claim 22, wherein the backing material is formed at least partially of a biodegradable material.

24. The playing surface of claim 22, wherein the fibers are tufted into the backing material.

25. The playing surface of claim 22, wherein the natural grass plants include roots, crowns and blades, the roots extending downwardly through the growth medium, the artificial grass turf, and into the foundation, the crowns being located slightly below the top of the artificial fibers and the blades extending upwardly from the crowns substantially above the top of the artificial fibers to form a playing surface of natural grass.

26. The playing surface of claim 22, wherein the foundation includes a perforated filter configured to permit the flow of water through the perforated filter and to substantially prevent the flow of other substances through the perforated filter.

27. The playing surface of claim 22, further comprising a cushioning layer of material positioned on top of the foundation, the cushioning material including rubber particles adhered together by urethane to create a flexible, perforated cushion.

28. The playing surface of claim 26, wherein the blades of the natural grass extend a sufficient distance above the top of the fibers to protect the artificial fibers from damage due to ultraviolet light.

29. The playing surface of claim 22, wherein the tops of the artificial fibers are adjacent the top of the second layer of growth medium.

* * * * *

UNITED STATES PATENT AND TRADEMARK OFFICE

CERTIFICATE OF CORRECTION

PATENT NO. : 5,489,317

DATED : February 6, 1996

INVENTOR(S) : J.G. Bergevin

It is certified that error appears in the above-indentified patent and that said Letters Patent is hereby corrected as shown below:

| COLUMN | LINE | |
|---|---|---|
| 1 | 44 | After "upon" insert --foundation-- |
| 1 | 50 | "surfaces they," should read --surfaces, they-- |
| 1 | 56 | "cream" should read --create-- |
| 1 | 58 | "cleosystem," should read --ecosystem,-- |
| 2 | 41 | "atop." should read --atop-- |
| 3 | 12 | After "120" insert --.-- |
| 3 | 13 | ". A" should read --A-- |
| 4 | 19 | "24" should read --42-- |
| 6 | 9 | "2 12" should read --212-- |
| 7 | 2 | "falter" should read --filter-- |
| 7 (Claim 5, | 55 line 3) | "all" should read --an-- |
| 7 (Claim 5, | 55 line 3) | "tile" should read --the-- |

UNITED STATES PATENT AND TRADEMARK OFFICE

CERTIFICATE OF CORRECTION

PATENT NO. : 5,489,317

DATED : February 6, 1996

INVENTOR(S) : J.G. Bergevin

It is certified that error appears in the above-indentified patent and that said Letters Patent is hereby corrected as shown below:

| COLUMN | LINE | |
|---|---|---|
| 7 (Claim 5, line 5) | 57 | "file" should read --the-- |
| 7 (Claim 5, line 8) | 60 | "ill" should read --in-- |
| 7 (Claim 5, line 10) | 62 | "tile" should read --the-- |
| 7 (Claim 5, line 12) | 64 | "tile" should read --the-- |
| 7 (Claim 5, line 12) | 64 | "tile" should read --the-- |
| 7 (Claim 5, line 13) | 65 | "he" should read --the-- |
| 7 (Claim 5, line 13) | 65 | "tile" should read --the-- |
| 7 (Claim 5, line 14) | 66 | After "foundation" insert "," |

UNITED STATES PATENT AND TRADEMARK OFFICE

CERTIFICATE OF CORRECTION

PATENT NO. : 5,489,317

DATED : February 6, 1996

INVENTOR(S) : J.G. Bergevin

It is certified that error appears in the above-indentified patent and that said Letters Patent is hereby corrected as shown below:

| COLUMN | LINE | |
|---|---|---|
| 8 (Claim 5, | 1 line 15) | "tile" should read --the-- |
| 8 (Claim 5, | 1 line 15) | "tile" should read --the-- |
| 8 (Claim 5, | 1 line 16) | "tile" should read --the-- |
| 8 (Claim 14, | 35 line 3) | "drowns" should read --crowns-- |
| 8 (Claim 14, | 36 line 4) | "file" should read --the-- |
| 8 (Claim 14, | 45 line 13) | "file" should read --the-- |
| 9 (Claim 22, | 45 line 7) | "file" should read --the-- |

UNITED STATES PATENT AND TRADEMARK OFFICE

CERTIFICATE OF CORRECTION

PATENT NO. : 5,489,317

DATED : Febraury 6, 1996

INVENTOR(S) : J.G. Bergevin

It is certified that error appears in the above-indentified patent and that said Letters Patent is hereby corrected as shown below:

| COLUMN | LINE | |
|---|---|---|
| 8 (Claim 14, | 45 line 13) | "file" should read --the-- |
| 9 (Claim 22, | 14 line 7) | "file" should read --, the--. |

Signed and Sealed this

Eighteenth Day of June, 1996

*Attest:*

Bruce Lehman

BRUCE LEHMAN

*Attesting Officer*

*Commissioner of Patents and Trademarks*

US005489317C1

(12) EX PARTE REEXAMINATION CERTIFICATE (6860th)

United States Patent

Bergevin

(10) Number: US 5,489,317 C1

(45) Certificate Issued: Jun. 9, 2009

(54) SURFACE FOR SPORTS AND OTHER USES

(75) Inventor: Jerry G. Bergevin, Lynnwood, WA (US)

(73) Assignee: Turf Stabilization Technologies, Inc., Newtown, OH (US)

Reexamination Request:
No. 90/005,525, Oct. 1, 1999

Reexamination Certificate for:

| | |
|---|---|
| Patent No.: | **5,489,317** |
| Issued: | **Feb. 6, 1996** |
| Appl. No.: | **08/319,322** |
| Filed: | **Oct. 4, 1994** |

Certificate of Correction issued Jun. 18, 1996.

Related U.S. Application Data

(63) Continuation of application No. 07/902,147, filed on Jun. 22, 1992, now abandoned.

(51) Int. Cl.
*E01C 13/00* (2006.01)

(52) U.S. Cl. ..... 47/1.01 R; 47/58.1 R

(58) Field of Classification Search ..... None
See application file for complete search history.

(56) References Cited

U.S. PATENT DOCUMENTS 4,396,653 A * 8/1983 Tomarin ..... 428/17
4,913,596 A * 4/1990 Lambert, III ..... 405/43

FOREIGN PATENT DOCUMENTS

WO WO 92/05316 * 4/1992

OTHER PUBLICATIONS

Notts Sport, *Grass Reinforcement VHAF*, pages from website.
Notts Sport, *Landscape VHAF Erosion Control Fabrics*, double–sided, single–page brochure, 1988.
Notts Sport, *Heavily Worn Golf Courses Cry Out For Repairs*, single page brochure, 1988.
Notts Sport, *VHAF Winter Games Pitches—Erosion Control Fabrics*, double–sided, single–page brochure, 1988.
Notts Sports, *Golf Courses—VHAF Erosion Control Fabrics*, double–sided, single–page brochure, 1988.
Notts Sports, *Grass Reinforcement VHAF Installation Instructions*, 1990.

* cited by examiner

*Primary Examiner*—Jeffrey L. Gellner

(57) ABSTRACT

An improved surface includes a foundation constructed of a subgrade and a sub-base. A synthetic turf is positioned atop the foundation and includes synthetic grass blades secured to a backing. The synthetic turf also includes a surface layer of material supported by the backing and intermixed with the synthetic grass blades. Natural grass is planted in the surface layer of material wherein the natural grass includes natural grass blades and roots. The backing is provided with perforations sufficient in number to permit the roots of the natural grass to extend through the backing into the sub-base of the foundation. The natural grass improves the overall desirability of the surface by improving its durability, increasing its life span, reducing the cost of installation, reducing the cost of maintenance, and improving the benefits to the ecology.

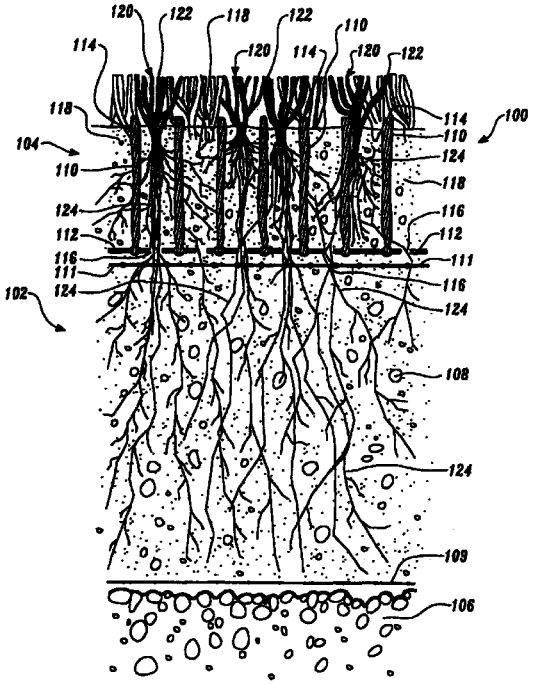

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–29 are cancelled.

* * * * *